US008441195B2

(12) United States Patent
Hsieh

(10) Patent No.: US 8,441,195 B2
(45) Date of Patent: May 14, 2013

(54) ILLUMINATION ADJUSTMENT CIRCUIT

(75) Inventor: Ming-Chih Hsieh, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 288 days.

(21) Appl. No.: 13/007,685

(22) Filed: Jan. 17, 2011

(65) Prior Publication Data

US 2012/0098438 A1 Apr. 26, 2012

(30) Foreign Application Priority Data

Oct. 20, 2010 (TW) ..... 99135654 A

(51) Int. Cl.
*H05B 37/02* (2006.01)

(52) U.S. Cl.
USPC ..... 315/149; 315/152; 315/154; 315/294; 315/297; 345/87; 345/207; 345/690; 250/204; 250/205; 250/214 AL

(58) Field of Classification Search ..... 315/149, 315/152, 154, 294, 297; 345/87, 207, 690; 250/204, 250/205, 214 AL
See application file for complete search history.

(56) References Cited

U.S. PATENT DOCUMENTS

| | | | | |
|---|---|---|---|---|
| 6,359,567 | B1 * | 3/2002 | Park | 340/632 |
| 2004/0017337 | A1 * | 1/2004 | Lin | 345/87 |
| 2006/0025949 | A1 * | 2/2006 | McCavit et al. | 702/85 |
| 2009/0078853 | A1 * | 3/2009 | Lin | 250/205 |

* cited by examiner

*Primary Examiner* — Douglas W Owens
*Assistant Examiner* — Thai Pham
(74) *Attorney, Agent, or Firm* — Altis Law Group, Inc.

(57) ABSTRACT

An illumination adjustment circuit includes a light sensitive unit, an amplification unit, a switch unit, and a light emitting unit. The switch unit includes a plurality of electronic switches with increasing threshold voltages. The light emitting unit includes a plurality of sets of light emitting diodes corresponding to the electronic switches. Each set of the light emitting diodes is connected to the amplification unit through one of the electronic switches corresponding thereto. The light sensitive unit detects the brightness of ambient light, outputting a first voltage to the amplification unit accordingly. The amplification unit amplifies the first voltage to a second voltage and outputs the second voltage to the switch unit, so that the electronic switches with the threshold voltages lower than the second voltage are turned on, and the set of light emitting diodes connected to the electronic switch becomes luminous.

15 Claims, 2 Drawing Sheets

ILLUMINATION ADJUSTMENT CIRCUIT

BACKGROUND

1. Technical Field

The present disclosure relates to an illumination adjustment circuit.

2. Description of Related Art

For enhancing image capture in darker environments, many video cameras utilize infrared emitting diodes. However, the infrared emitting diodes are often operated by simply being turned on or off. However, turning on the infrared emitting diodes when some ambient light is present can generate an excessive level of brightness. When the infrared emitting diodes are turned off altogether when ambient light is not adequate, insufficient brightness remains. Thus, without precise adjustment of the infrared emitting diodes, image capture is negatively affected.

BRIEF DESCRIPTION OF THE DRAWINGS

Many aspects of the present device can be better understood with reference to the following drawings. The components in the drawings are not necessarily drawn to scale, the emphasis instead being placed upon clearly illustrating the principles of the present heat dissipation apparatus and the present heat dissipation method. Moreover, in the drawings, like reference numerals designate corresponding parts throughout the several views.

DETAILED DESCRIPTION

Figure 1:
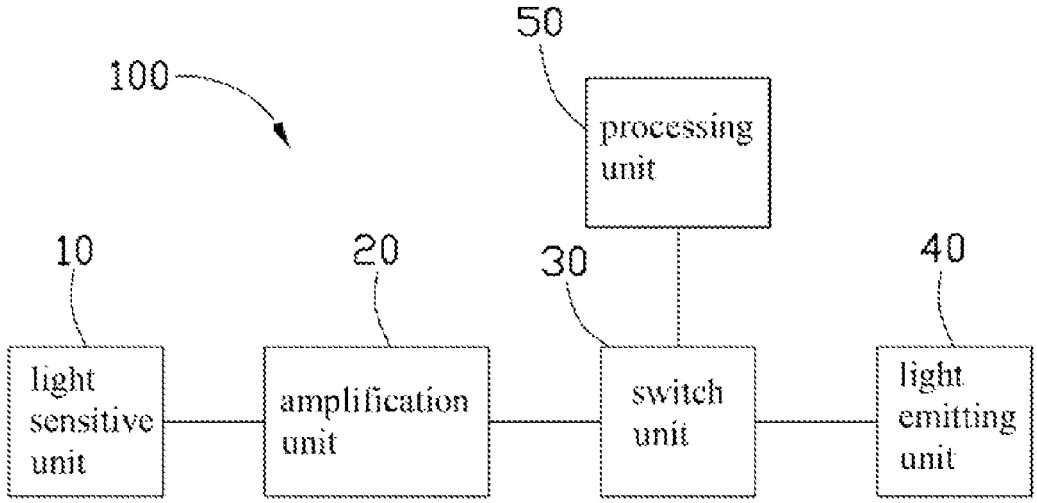
FIG. 1 is a block diagram of a preferred embodiment of an illumination adjustment circuit of the present disclosure.

As shown in FIG. 1, an illumination adjustment circuit of the present disclosure includes a light sensitive unit 10, an amplification unit 20, a switch unit 30, a light emitting unit 40, and a processing unit 50. The amplification unit 20 connects to the light sensitive unit 10 and connects to the light emitting unit 40 through the switch unit 30. The switch unit 30 further connects to the processing unit 50. The light sensitive unit 10 detects the brightness of ambient light, outputting a first voltage V1 (shown in FIG. 2) to the amplification unit 20 accordingly. The amplification unit 20 amplifies the first voltage V1 to a second voltage V2 (shown in FIG. 2) and outputs the second voltage V2 to the switch unit 30, turning the switch unit 30 on and off, thereby controlling the brightness of the light emitting unit 40. The processing unit 50 detects the on/off status of the switches 30, thereby determining the luminous status of the light emitting unit 40. In this embodiment, the illumination adjustment circuit is disposed in a video camera to provide adequate light source brightness to the video camera. The processing unit 50 is the processing unit in the video camera such as a microprocessor. The processing unit 50 adjusts the parameters in the video camera corresponding to the luminous status of the light emitting unit 40, optimizing illumination for image capture.

Figure 2:
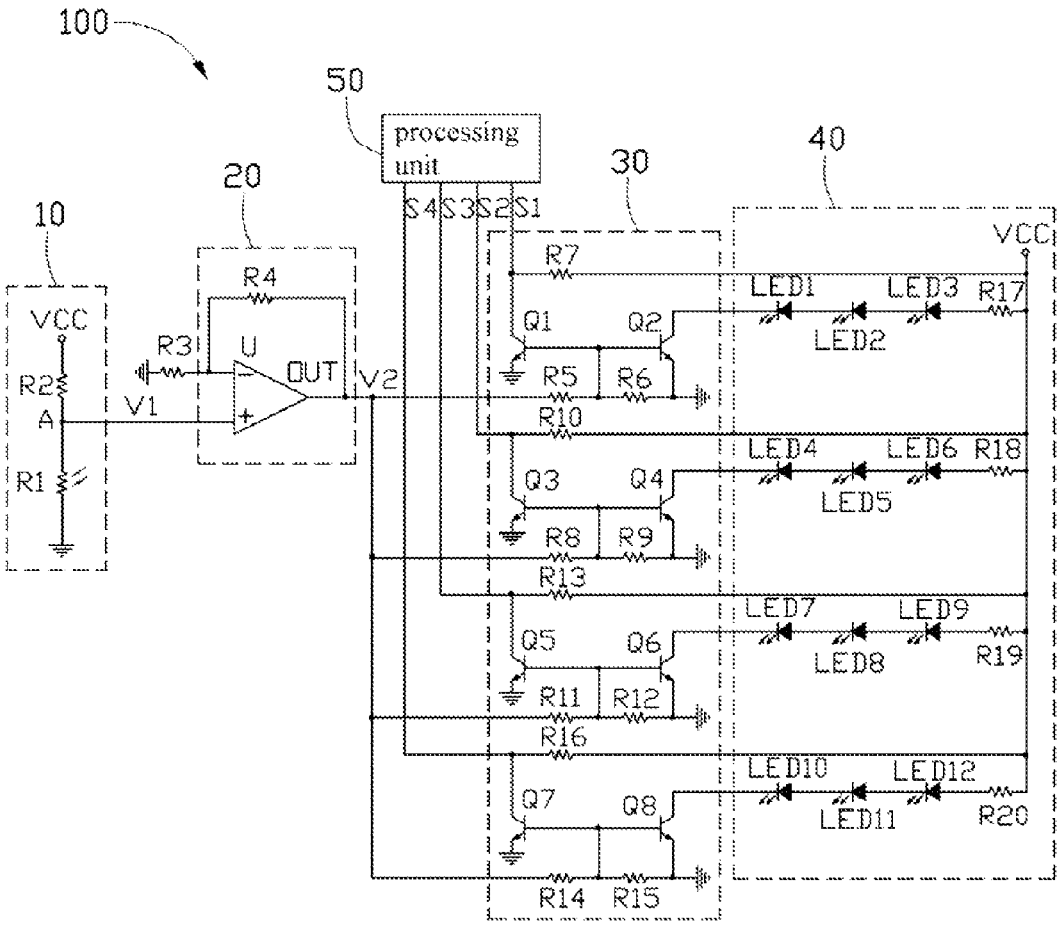
FIG. 2 is a circuit diagram of the preferred embodiment of an illumination adjustment circuit of the present disclosure.

As shown in FIG. 2, the light sensitive unit 10 includes a light sensitive resistor R1. One terminal of the light sensitive resistor R1 is connected to a power supply VCC through a resistor R2, and the other terminal of the light sensitive resistor R1 is grounded. Anode A is disposed between the light sensitive resistor R1 and the resistor R2. The node A behaves as an output terminal of the light sensitive unit 10 to output the first voltage V1. In this embodiment, the first voltage $$V1 = \frac{VCC \times R1}{R1 + R2},$$

wherein VCC is the voltage of the power supply VCC.

The amplification unit 20 includes an amplifier U. The amplifier U includes a non-inverting input terminal, a inverting input terminal, and an output terminal OUT. The non-inverting input terminal is connected to the node A to receive the first voltage V1. The inverting input terminal is grounded through a resistor R3 and connected to the output terminal OUT through a resistor R4. The output terminal OUT outputs the second voltage V2. In this embodiment, the amplification factor G of the amplifier U can be shown as $$G = \frac{V2}{V1} \text{ and } G = 1 + \frac{R4}{R3},$$

thus $$V2 = V1 \times \left(1 + \frac{R4}{R3}\right).$$

In other embodiments, the amplification factor of the amplifier U can be adjusted according to actual demand.

The switch unit 30 includes four switches. The first switch includes two electronic switches Q1 and Q2; the second switch includes two electronic switches Q3 and Q4; the third switch includes two electronic switches Q5 and Q6; and the fourth switch includes two electronic switches Q7 and Q8. A first terminal of the electronic switch Q1 behaves as an input terminal of the first switch which connects to the output terminal OUT of the amplifier U through a resistor R5, and is grounded through a resistor R6. A second terminal of the electronic switch Q1 behaves as a first output terminal of the first switch to connect to the processing unit 50, and further connects to the power supply VCC through a resistor R7. A first terminal of the electronic switch Q2 connects to the first terminal of the electronic switch Q1, and a second terminal of the electronic switch Q2 behaves as a second output terminal of the first switch to connect to the light emitting unit 40. A first terminal of the electronic switch Q3 behaves as an input terminal of the second switch to connect to the output terminal OUT of the amplifier U through a resistor R8, and is grounded through a resistor R9. A second terminal of the electronic switch Q3 behaves as a first output terminal of the second switch to connect to the processing unit 50, and further connects to the power supply VCC through a resistor R10. A first terminal of the electronic switch Q4 connects to the first terminal of the electronic switch Q3,and a second terminal of the electronic switch Q4 behaves as a second output terminal of the second switch to connect to the light emitting unit 40. A first terminal of the electronic switch Q5 behaves as an input terminal of the third switch to connect to the output terminal OUT of the amplifier U through a resistor R11, and is grounded through a resistor R12. A second terminal of the electronic switch Q5 behaves as a first output terminal of the third switch to connect to the processing unit 50, and further connects to the power supply VCC through a resistor R13. A first terminal of the electronic switch Q6 connects to the first terminal of the electronic switch Q5, and a second terminal of the electronic switch Q6 behaves as a second output terminal of the third switch to connect to the light emitting unit 40. A first terminal of the electronic switch Q7 behaves as an input terminal of the fourth switch to connect to the output terminal OUT of the amplifier U through a resistor R14, and is grounded through a resistor R15. A second terminal of the electronic switch Q7 behaves as a first output terminal of the fourth switch to connect to the processing unit 50 to connect to the power supply VCC through a resistor R16. A first terminal of the electronic switch Q8 connects to a first terminal of the electronic switch Q7, and a second terminal of the electronic switch Q8 behaves as a second output terminal of the fourth switch to connect to the light emitting unit 40. Third terminals of the electronic switch Q1-Q8 are grounded.

In this embodiment, the electronic switches Q1-Q8 are NPN type transistors. The first terminal, the second terminal, and the third terminal of each of the electronic switches correspond to the base, the collector and the emitter of NPN type transistor, respectively. The threshold voltage of the two electronic switches Q1 and Q2 are the same; the threshold voltage of the two electronic switches Q3 and Q4 are the same and higher than the threshold voltage of the two electronic switches Q1 and Q2; the threshold voltage of the two electronic switches Q5 and Q6 are the same and higher than the threshold voltage of the two electronic switches Q3 and Q4; and the threshold voltage of the two electronic switches Q7 and Q8 are the same and higher than the threshold voltage of the two electronic switches Q5 and Q6. In other words, the threshold voltages of the four switches are increased one by one. In other embodiments, the resistors R5, R6, R8, 9, R11, R12, R14, and R15 can be omitted. Consequently, the first terminals of the electronic switches Q1-Q8 connect to the output terminal OUT of the amplifier U directly. Alternatively, the electronic switches Q1-Q8 can be NMOS transistors or other types of electronic switches.

The light emitting unit 40 includes four sets of light emitting diodes. The first set of light emitting diodes includes three light emitting diodes LED1-LED3, sequentially connected in series; the second set of the light emitting diodes includes three light emitting diodes LED4-LED6 sequentially connected in series; the third set of light emitting diodes includes three light emitting diodes LED7-LED9 sequentially connected in series; and the fourth set of light emitting diodes includes three light emitting diodes LED10-LED12 sequentially connected in series. The cathode of the light emitting diode LED1 connects to the second terminal of the electronic switch Q2; the anode of the light emitting diode LED1 connects to the cathode of the light emitting diode LED2; the anode of the light emitting diode LED2 connects to the cathode of the light emitting diode LED3; and the anode of the light emitting diode LED3 connects to the power supply VCC through a resistor R17. The cathode of the light emitting diode LED4 connects to the second terminal of the electronic switch Q4; the anode of the light emitting diode LED 4 connects to the cathode of the light emitting diode LED5; the anode of the light emitting diode LED5 connects to the cathode of the light emitting diode LED6; and the anode of the light emitting diode LED6 connects to the power supply VCC through a resistor R18. The cathode of the light emitting diode LED7 connects to the second terminal of the electronic switch Q6; the anode of the light emitting diode LED7 connects to the cathode of the light emitting diode LED8; the anode of the light emitting diode LED8 connects to the cathode of the light emitting diode LED9; and the anode of the light emitting diode LED9 connects to the power supply VCC through a resistor R19. The cathode of the light emitting diode LED10 connects to the second terminal of the electronic switch Q8; the anode of the light emitting diode LED10 connects to the cathode of the light emitting diode LED11; the anode of the light emitting diode LED11 connects to the cathode of the light emitting diode LED12; and the anode of the light emitting diode LED12 connects to the power supply VCC through a resistor R20. In this embodiment, the light emitting diodes LED1-LED12 are infrared emitting diodes. In other embodiments, the number of the switches included in the switch unit 30, the sets of light emitting diodes included in the light emitting unit 40, and the number of light emitting diodes included in each set of light emitting diodes can be changed according to actual demand, and the number of the switches included in the switch unit 30 is equal to that of the sets of light emitting diodes in the light emitting unit 40.

During operation, the light sensitive unit 10 detects the brightness of ambient light since electrical resistance of the light sensitive resistor R1 increases in respond to the decrement of the brightness of ambient light.

When ambient light is adequate, the electrical resistance of the light sensitive resistor R1 is small. Correspondingly, the first voltage V1 is small, as is the second voltage V2 output by the amplifier U amplifying the first voltage V1. Concurrently, the second voltage V2 is smaller than the threshold voltage of the two electronic switches Q1 and Q2, and the electronic switches Q1-Q8 are turned off. Hence, the light emitting diodes LED1-LED12 are not in operation, and the processing unit 50 determines that the light emitting diodes LED1-LED12 are not in operation by the detected status signals with high potential.

When ambient light decreases in brightness, the electrical resistance of the light sensitive resistor R1 increases gradually. Correspondingly, the first voltage V1 increases, and the second voltage V2 output by the amplifier U increases. When the second voltage V2 is greater than the threshold voltage of the two electronic switches Q1 and Q2, the electronic switches Q1 and Q2 are turned on. Hence, the first set of light emitting diodes LED1-LED3 become luminous to complement the brightness of ambient light, and the processing unit 50 determines that the light emitting diodes LED1-LED3 have become luminous by the detected status signal S1 with low potential.

As ambient light decreases, the electrical resistance of the light sensitive resistor R1 continues to increase. Correspondingly, the first voltage V1 increases, and the second voltage V2 output by the amplifier U increases. When the second voltage V2 is greater than the threshold voltage of the two electronic switches Q3 and Q4, the electronic switches Q1-Q4 are turned on. Hence, the light emitting diodes LED1-LED6 become luminous to further complement the brightness of ambient light, and the processing unit 50 determines that the light emitting diodes LED1-LED6 have become luminous by the detected status signal S1 and S2 with low potential.

When ambient light is further reduced, the electrical resistance of the light sensitive resistor R1 still continues to increase. Correspondingly, the first voltage V1 increases, and the second voltage V2 output by the amplifier U increases. When the second voltage V2 is greater than the threshold voltage of the two electronic switches Q5 and Q6, the electronic switches Q1-Q6 are turned on. Hence, the first set of the light emitting diodes LED1-LED9 become luminous to still further complement the brightness of ambient light, and the processing unit 50 determines that the light emitting diodes LED1-LED9 have become luminous by the detected status signal S1-S3 with low potential.

When there is no ambient light, the electrical resistance of the light sensitive resistor R1 increases again. Correspondingly, the first voltage V1 increases, and the second voltage V2 output by the amplifier U increases. When the second voltage V2 is greater than the threshold voltage of the two electronic switches Q7 and Q8, the electronic switches Q1-Q8 are turned on. Hence, the light emitting diodes LED1-LED12 become luminous to provide a light source with adequate brightness, and the processing unit 50 determines that the light emitting diodes LED1-LED12 have become luminous by the detected status signal S1-S4 with low potential.

In other embodiments, the illumination adjustment circuit 100 can be disposed in other electronic devices. In addition, when the electronic device can adjust the parameters therein without determining the luminous status of the light emitting unit 40, the processing unit 50 can be omitted. Correspondingly, the electronic switches Q1, Q3, Q5, Q7 and the resistors R7, R10, R3, R16 can be omitted.

The illumination adjustment circuit 100 of the present disclosure utilizes the light sensitive unit 10 to detect the brightness of ambient light, and the switch unit 30 to control the brightness of the light emitting unit 40, so as to precisely adjust the brightness of light sources and enhance image capture illumination capability.

While the invention has been described by way of example and in terms of preferred embodiment, it is to be understood that the invention is not limited thereto. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. An illumination adjustment circuit comprising:

a light sensitive unit;

an amplification unit;

a switch unit including a plurality of electronic switches with increasing threshold voltages;

a light emitting unit including a plurality of sets of light emitting diodes corresponding to the electronic switches, wherein each set of the light emitting diodes is connected to the amplification unit through one of the electronic switches corresponding thereto; and a processing unit connecting to each of the switches, wherein the processing unit detects the on/off status of the switches, and determines the luminous status of the sets of light emitting diodes by detected status signals;

wherein the light sensitive unit detects the brightness of ambient light, outputting a first voltage to the amplification unit accordingly, the amplification unit amplifies the first voltage to a second voltage and outputs the second voltage to the switch unit, so that the electronic switches with the threshold voltages lower than the second voltage are turned on, and the set of light emitting diodes connected to the electronic switches are turned on.

2. The illumination adjustment circuit of claim 1, wherein the light sensitive unit includes a light sensitive resistor, one terminal of the light sensitive resistor is connected to a power supply through a first resistor and the other terminal thereof is grounded, a node disposed between the light sensitive resistor and the first resistor behaves as a output terminal of the light sensitive unit and outputs the first voltage.

3. The illumination adjustment circuit of claim 2, wherein the amplification unit includes an amplifier including a non-inverting input terminal, a inverting input terminal, and an output terminal, the non-inverting input terminal connects to the node so as to receive the first voltage, the inverting input terminal is grounded through a second resistor and connected to the output terminal through a third resistor, the output terminal outputs the second voltage.

4. The illumination adjustment circuit of claim 3, wherein each of the electronic switches includes a first terminal, a second terminal, and a third terminal, the first terminal of each of the electronic switches connects to the output terminal of the amplifier, the second terminal of each of the electronic switches connects to one of the light emitting diodes corresponding thereto, the third terminal of each of the electronic switches is grounded.

5. The illumination adjustment circuit of claim 4, wherein the electronic switches are NPN type transistors, the first terminal, the second terminal, and the third terminal of each of the electronic switches correspond to the base, the collector and the emitter of the NPN type transistors, respectively.

6. The illumination adjustment circuit of claim 4, wherein each set of the light emitting diodes includes at least a light emitting diode, one terminal of the light emitting diode connects to the second terminal of the electronic switch corresponding thereto, and the other terminal of the light emitting diode connects to the power supply, the light emitting diodes becomes luminous when the corresponding electronic switch is turned on.

7. The illumination adjustment circuit of claim 6, wherein the light emitting diodes are infrared emitting diodes, one terminal and the other terminal of the infrared emitting diodes correspond to the cathode and the anode of the infrared emitting diodes, respectively.

8. The illumination adjustment circuit of claim 1, wherein the other electronic switches with the threshold voltages higher than the second voltage are turned off, and the set of light emitting diodes connected to the other electronic switches are turned off.

9. An illumination adjustment circuit comprising:

a light sensitive unit;

an amplification unit;

a switch unit including a plurality of switches with increasing threshold voltages;

a light emitting unit; and a processing unit, wherein the light emitting unit includes a plurality of sets of light emitting diodes corresponding to the switches, an input terminal of each of the switches connects to the amplification unit, a first output terminal of each of the switches connects to the processing unit, and a second output terminal of each of the switches connects to the set of light emitting diodes corresponding thereto, the processing unit detects the on/off status of the switches, and determines the luminous status of the sets of light emitting diodes by detected status signals;

wherein the light sensitive unit detects the brightness of ambient light, outputting a first voltage to the amplification unit accordingly, the amplification unit amplifies the first voltage to a second voltage and outputs the second voltage to the switch unit, so that the electronic switches with the threshold voltages lower than the second voltage are turned on, and the set of light emitting diodes of the light emitting unit connected to the switches are turned on.

10. The illumination adjustment circuit of claim 9, wherein the light sensitive unit includes a light sensitive resistor, one terminal of the light sensitive resistor is connected to a power supply through a first resistor and the other terminal thereof is grounded, a node disposed between the light sensitive resistor and the first resistor behaves as a output terminal of the light sensitive unit and outputs the first voltage.

11. The illumination adjustment circuit of claim 10, wherein the amplification unit includes an amplifier including a non-inverting input terminal, a inverting input terminal, and an output terminal, the non-inverting input terminal connects to the node so as to receive the first voltage, the inverting input terminal is grounded through a second resistor and connected to the output terminal through a third resistor, the output terminal outputs the second voltage.

12. The illumination adjustment circuit of claim 11, wherein each of the switches includes a first electronic switch and a second electronic switch, a first terminal of the first electronic switch behaves as a input terminal of the switch corresponding thereto to connect to the output terminal of the amplifier, a second terminal of the first electronic switch behaves as a first output terminal of the switch corresponding thereto to connect to the processing unit, a first terminal of the second electronic switch connects to the first terminal of the first electronic switch, a second terminal of the second electronic switch behaves as a second output terminal of the switch corresponding thereto to connect to one of the light emitting diode corresponding thereto, a third terminal of the first switch and the second switch are grounded.

13. The illumination adjustment circuit of claim 12, wherein the first electronic switches and the second electronic switches are NPN type transistors, the first terminal, the second terminal, and the third terminal of each of the electronic switches correspond to the base, the collector and the emitter of the NPN type transistors, respectively.

14. The illumination adjustment circuit of claim 12, wherein each set of the light emitting diodes includes at least a light emitting diode, one terminal of the light emitting diode connects to the second terminal of the second electronic switch corresponding thereto, and the other terminal of the light emitting diode connects to the power supply, the light emitting diode becomes luminous when the second electronic switch corresponding thereto is turned on.

15. The illumination adjustment circuit of claim 14, wherein the light emitting diodes are infrared emitting diodes, one terminal and the other terminal of the infrared emitting diodes correspond to the cathode and the anode of the infrared emitting diodes, respectively.

* * * * *